US009617731B2

(12) United States Patent
Baxter et al.

(10) Patent No.: US 9,617,731 B2
(45) Date of Patent: Apr. 11, 2017

(54) MODULAR WALL SYSTEM AND KIT INCORPORATING EXTRUDED END INTERLOCKING PORTIONS IN ADDITION TO BASE SUPPORT TRACK MOLDING AND ATTACHABLE TOP CAP

(71) Applicant: U.S. Farathane Corporation, Auburn Hills, MI (US)

(72) Inventors: Kevin Charles Baxter, Goodrich, MI (US); David Brian Parpart, Oakland, MI (US)

(73) Assignee: U.S. Farathane Corporation, Auburn Hills, MI (US)

( * ) Notice: Subject to any disclaimer, the term of this patent is extended or adjusted under 35 U.S.C. 154(b) by 0 days.

(21) Appl. No.: 15/015,181

(22) Filed: Feb. 4, 2016

(65) Prior Publication Data

US 2016/0356037 A1 Dec. 8, 2016

Related U.S. Application Data

(60) Provisional application No. 62/171,089, filed on Jun. 4, 2015.

(51) Int. Cl.
*E04B 2/74* (2006.01)
*E04B 1/61* (2006.01)

(52) U.S. Cl.
CPC ..... *E04B 2/7405* (2013.01); *E04B 1/6112* (2013.01); *E04B 2002/7487* (2013.01)

(58) Field of Classification Search
CPC ..... E04B 1/6112; E04B 2/7405; E04B 2002/7487; E04B 2002/0206; E04B 2002/0232; E04B 2002/0247; E04B 2002/025; E04F 2002/02077; E04F 2002/02088; E04F 2002/02083; E04F 2002/02094; E04F 2002/02122
USPC .. 52/578, 582.1, 582.2, 584.1, 586.1, 586.2, 52/585.1, 309.11
See application file for complete search history.

(56) References Cited

U.S. PATENT DOCUMENTS 3,367,076 A * 2/1968 O'Brien ..... E04C 2/296 52/309.11
3,765,135 A * 10/1973 Gerhardt ..... F27D 1/06 52/592.4
3,789,567 A * 2/1974 Rae ..... E04B 1/68 52/584.1

(Continued)

FOREIGN PATENT DOCUMENTS

EP 0814214 A2 12/1997
GB 287247 A 3/1928

(Continued)

*Primary Examiner* — Brent W Herring
(74) *Attorney, Agent, or Firm* — Dinsmore & Shohl LLP; Douglas Mcevoy

(57) ABSTRACT

A modular wall system including a plurality of panels, each having a plurality of interconnecting sides including a top, a bottom, a first joiner edge and a second joiner edge. The first and second joiner edges of the panels each further include a pair of first and second side edge projecting profiles, the profiles each exhibiting mating and friction fitting locations such that the panels are inter-engaged in either of linear or angled extending fashion. A floor supported track is provided for seating the bottoms of the interconnecting panels.

9 Claims, 9 Drawing Sheets

(56) References Cited

U.S. PATENT DOCUMENTS 3,828,502 A * 8/1974 Carlsson ..... E04B 1/14 52/125.4
4,037,377 A * 7/1977 Howell ..... E04C 2/296 52/309.9
4,107,892 A * 8/1978 Bellem ..... E04C 2/296 52/396.04
4,703,985 A * 11/1987 Finkbeiner ..... H02G 3/288 174/481
4,744,185 A * 5/1988 Lamberet ..... E04C 2/292 52/309.11
4,835,921 A * 6/1989 Baggett, Jr. ..... B29C 66/1122 52/220.7
4,866,891 A * 9/1989 Young ..... E04B 2/8641 52/105
5,305,567 A * 4/1994 Wittler ..... E04B 2/7425 160/135
5,325,649 A * 7/1994 Kajiwara ..... E04B 1/6179 403/340
6,006,480 A 12/1999 Rook
6,256,960 B1 * 7/2001 Babcock ..... E04B 1/14 52/281
7,127,865 B2 * 10/2006 Douglas ..... E02D 27/02 52/270
7,373,762 B2 5/2008 Hubbard
7,900,411 B2 * 3/2011 Antonic ..... E02D 27/02 52/275
8,429,858 B1 4/2013 Robinson et al.
8,707,648 B2 4/2014 Timko et al.
8,997,436 B2 * 4/2015 Spear ..... E04F 13/0894 52/239
2013/0199118 A1 8/2013 Strassle et al.

FOREIGN PATENT DOCUMENTS

GB 2427628 A 1/2007
WO 9004073 A1 4/1990
WO 94/28262 A2 12/1994
WO 2010080072 A2 7/2010
WO 2011/141591 A1 11/2011

* cited by examiner

MODULAR WALL SYSTEM AND KIT INCORPORATING EXTRUDED END INTERLOCKING PORTIONS IN ADDITION TO BASE SUPPORT TRACK MOLDING AND ATTACHABLE TOP CAP

BACKGROUND OF THE INVENTION

The present application claims the priority of U.S. Ser. No. 62/171,089 filed Jun. 4, 2015, the contents of which is incorporated herein in its entirety.

FIELD OF THE INVENTION

The present invention relates generally to modular, typically interior erected, wall systems. More specifically, the present invention discloses a wall system incorporating a plurality of polymeric based and foam filled panels which integrate side edge extending and inter-engageable, typically rigid PVC, extrusions. Bottom edges of the joined panels are supported upon a track configured base molding, a separate top cap attaching along an upper continuous edge established by the interlocking panels. Corner moldings are also provided and which substitute for a given side edge extrusion for forming such as a ninety degree angle or curved profile between succeeding panels.

DESCRIPTION OF THE BACKGROUND ART

The prior art is documented with varying types of assembleable and free-standing support structures, such as which are positioned within a building and utilized to subdivide an interior space. A first example is shown in EP 0 814 214, to Plamet LLC, which teaches a system of structural elements for building internal walls. The system provides hollow parallelepiped modular components each composed of two interlocking half shells with a C-shaped inner core and a U-shaped section for housing the core.

WO 94/28262, to De Zen, further teaches an elongated extruded thermoplastic building component for use in erecting a thermoplastic building structure, such being extruded from a PVC material and containing a reinforcing and expansion controlling agent selected from mineral fibers, glass fibers and calcium carbonate. A coextruded thermoplastic skin is applied to the components. Openings are bored into the web of the structural components immediately after extrusion and while still feeding away from the extruder, with the material removed from the web returned for reuse as a core extrusion material.

Other examples include the multi-functional building assembly of Hubbard, U.S. Pat. No. 7,373,762 and the frame profile system of Strassle 2013/0199118. Finally, reference is made to the low cost and prefabricated housing system of Rook, U.S. Pat. No. 6,006,480.

SUMMARY OF THE PRESENT INVENTION

The present invention discloses a modular wall system including a plurality of panels, each having a plurality of interconnecting sides including a top, a bottom, a first joiner edge and a second joiner edge. The first and second joiner edges of the panels each further include a pair of first and second side edge projecting profiles, the profiles each exhibiting mating and friction fitting locations such that the panels are inter-engaged in extending fashion. A floor supported track is provided for seating the bottoms of the interconnecting panels.

Other features include a top cap for securing the tops of the interconnecting panels. The track further includes a base or floor support surface, from which upwardly extends first and second spaced apart walls, inside opposing surfaces of said walls and an interconnecting upper surfaces of said floor support collectively defining a generally rectangular shaped pocket for seating and supporting the bottom and bottom proximate sides of each of said panels in upstanding fashion.

Each of the side edge projecting profiles further includes an elongated extrusion having an outer three sided configuration with a longer outer side, a shorter spaced apart outer side, and an interconnecting inner or back surface, the mating and friction fitting associated with the extrusions being established by inner stepped and outwardly projecting portions associated with each extrusion. The projecting portions are inwardly stepped from the shorter outer sides, such that the shorter sides and inwardly stepped projecting portions respectively establish outwardly facing engagement ledges for receiving the outermost extending portions of the longer sides.

Additional features include the panels each further having first outer and harder plastic skins in combination with foam insulating interiors. The top cap further includes a generally "U" shaped cross sectional profile with a base and interconnecting and parallel spaced outer walls. Each of the joiner edge profiles, top cap and bottom track further include a rigid PVC material.

Other features include a corner molding for engaging opposing first and second side edge extending profiles associated with first and second panels and in order to array the panels in an angular fashion relative to one another. Without limitation, the corner moldings can include any of angled or curved configurations and terminating at opposite ends in inwardly stepped engaging portions which interface between the ends of the central body and the engaging portions.

BRIEF DESCRIPTION OF THE DRAWINGS

Reference will now be made to the attached drawings, when read in combination with the following detailed description, wherein like reference numerals refer to like parts throughout the several views, and in which.

DETAILED DESCRIPTION OF THE PREFERRED EMBODIMENTS

As previously described, the present invention discloses a wall system, such as in one embodiment being a free standing structure erected within an open building interior. Without limitation, the system incorporates a plurality of polymeric based and foam filled panels, these integrating side edge extending and inter-engageable, typically rigid PVC, extrusions. Bottom edges of the panels are supported upon a track configured base molding, a separate top cap attaching along an upper continuous edge established by the interlocking panels.

Figure 1:
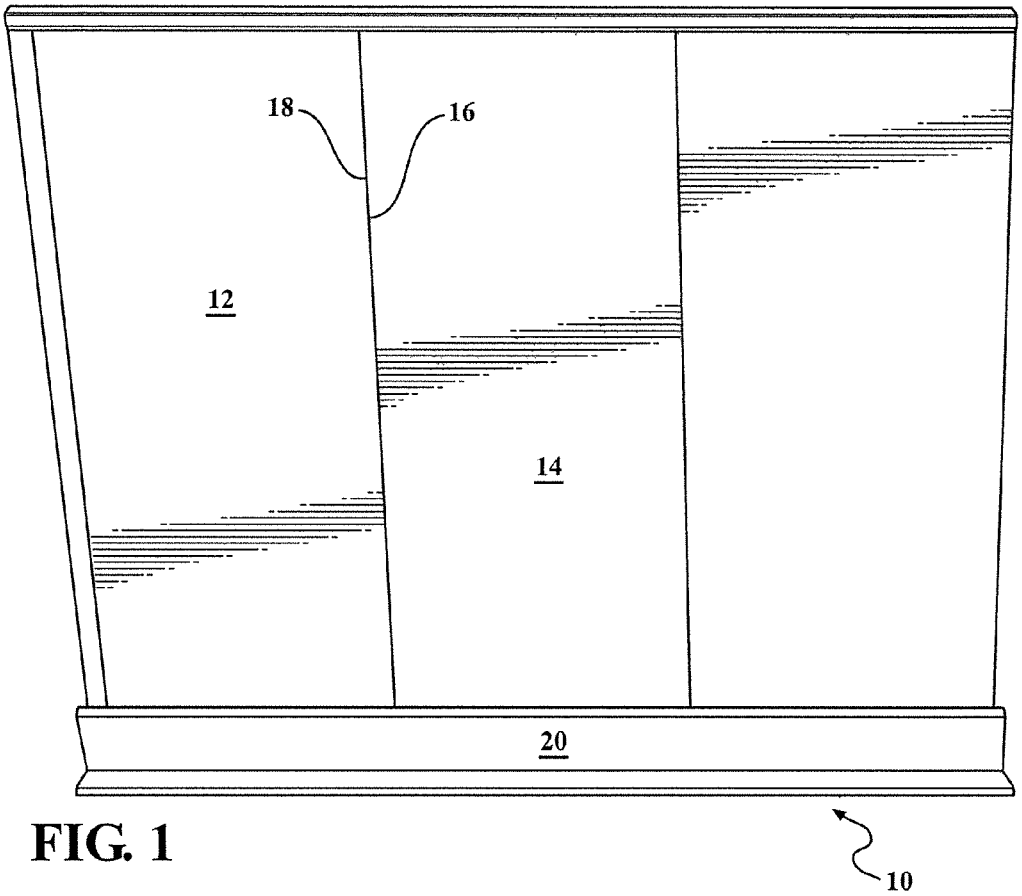
FIG. 1 is an environmental view of the modular wall system according to one non-limiting embodiment of the present inventions.

Referring initially to FIG. 1, an environmental view is generally shown at 10 of the modular wall system according to one non-limiting embodiment of the present inventions. The kit and system includes any number of panels, see at 12 and 14, which are joined together along common opposing edges, further at 16 and 18. A base supporting track 20 is provided and includes a lengthwise extending channel recess which supported bottom extending and interconnecting edges (not shown) of the panels.

Figure 2:
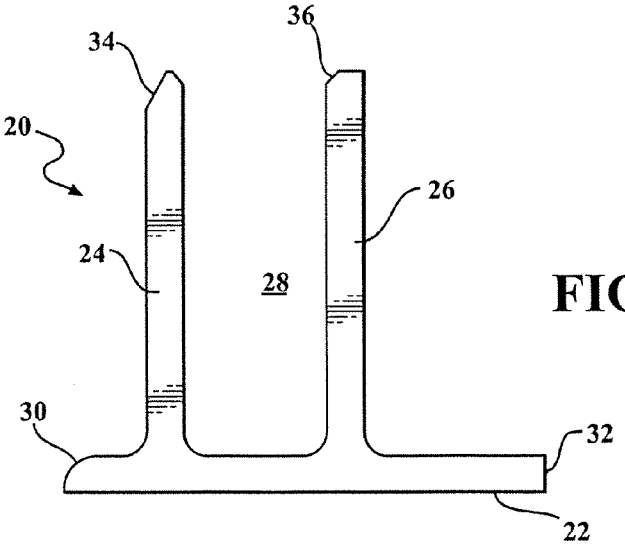
FIG. 2 is an enlarged cross section of a track section for supporting an extending bottom edge of the interconnected panels.

FIG. 2 is an enlarged cross section of a selected track section 20 for supporting an extending bottom edge of the interconnected panels. As shown, the track section 20 may be constructed of a rigid PVC (poly vinyl chloride) or other suitable material and includes a base or floor support surface 22, from which upwardly extend first 24 and second 26 spaced apart walls.

The inside opposing surfaces of the walls 24 and 26 and the interconnecting upper surfaces of the floor support 22 collectively define a generally rectangular shaped pocket 28 for seating and supporting the bottom and bottom proximate sides of each panel in upstanding fashion. As further shown, the cross sectional depiction of the floor support 22 can include opposite extending profile edge contours, see arcuate at 30 and flattened at 32. The uppermost edges of the walls 24 and 26 may also exhibit variously notched or angled edge profiles, at 34 and 36 respectively, and which can include any variation of a lead-in angle or profile to facilitate vertical insertion and subsequent mounting support of the panels 12, 14, et seq.

Figure 4:
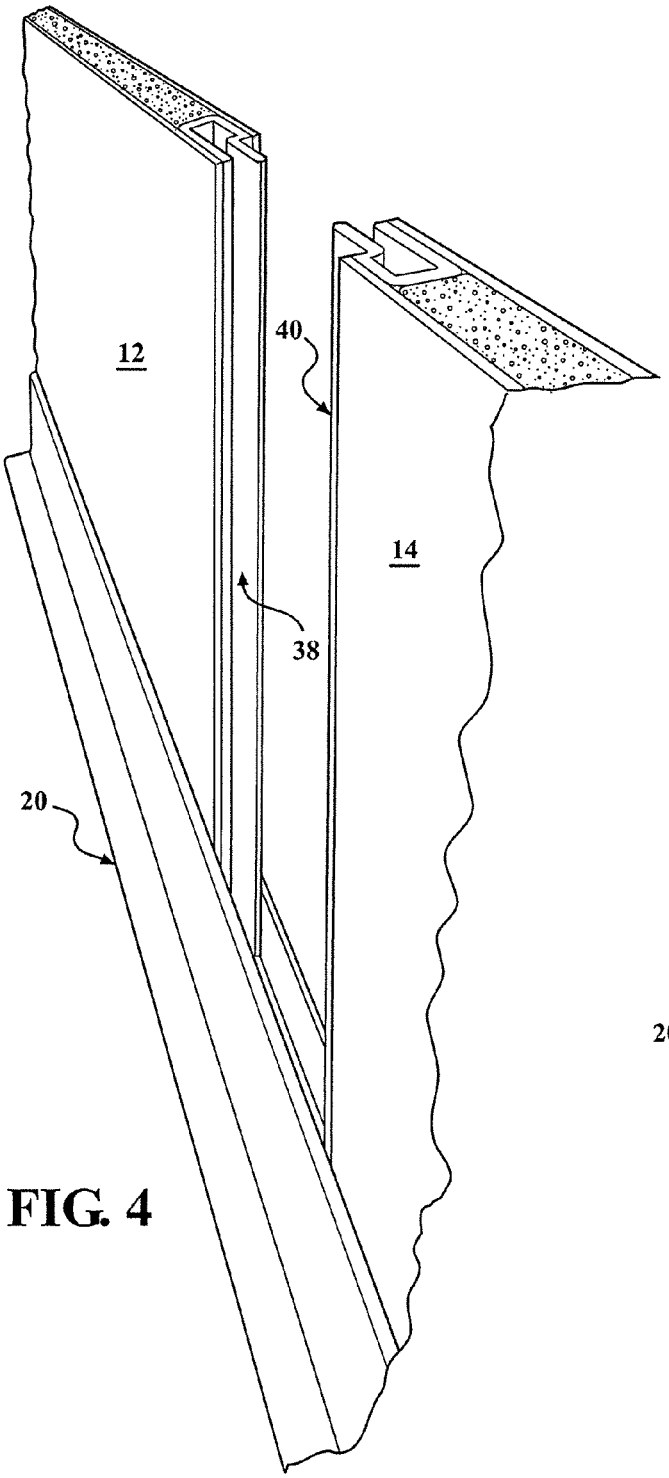
FIG. 4 is a rotated perspective of the system of FIG. 3 depicting first and second panels with opposing wall joiner edge extrusions arrayed in partially spaced fashion.
Figure 3:
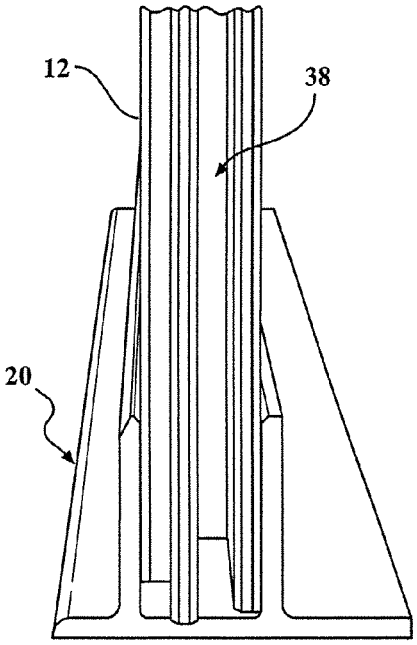
FIG. 3 is an environmental end view of the wall system including base/track supporting molding and a selected panel with wall joiner edge extrusion.
Figure 7:
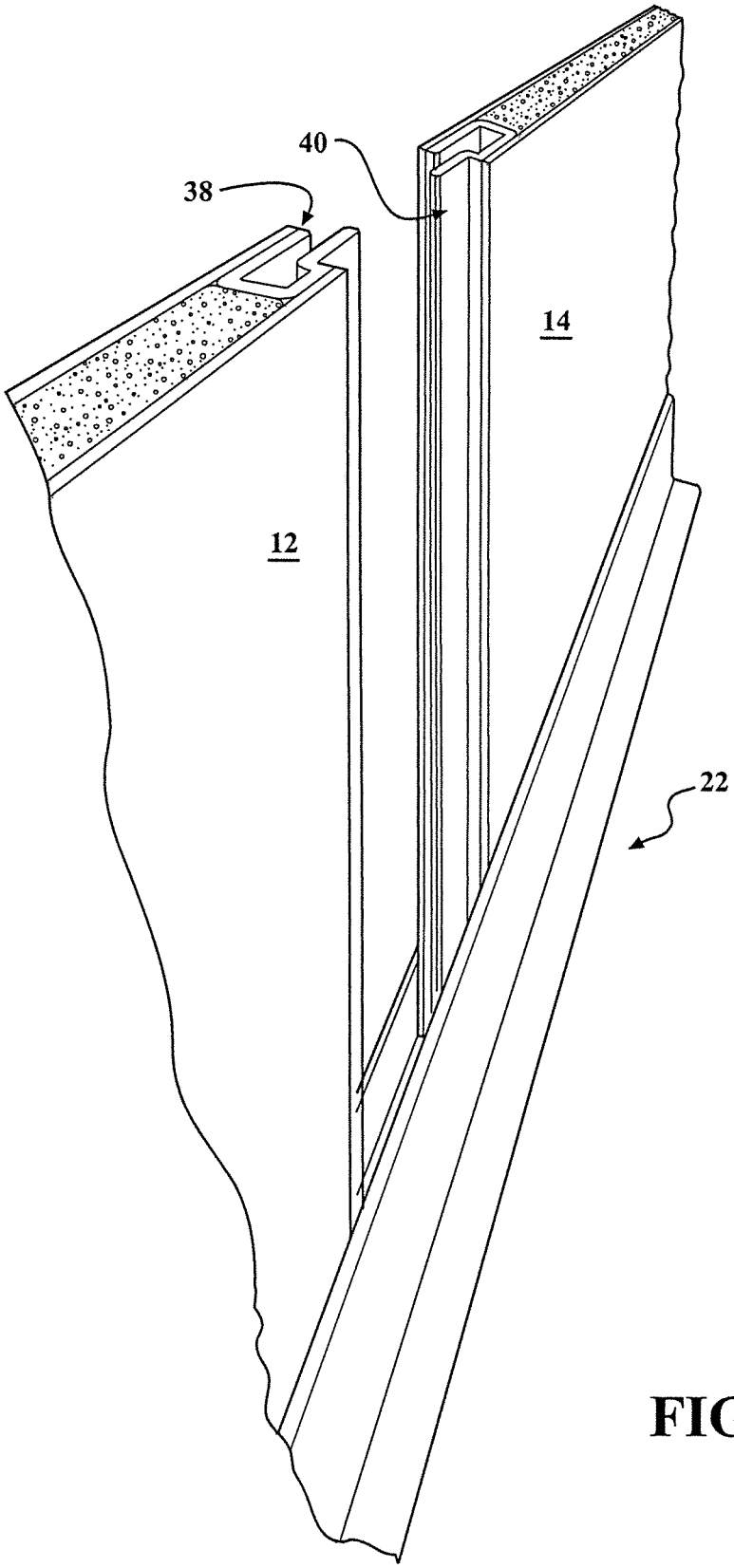
FIGS. 7 and 8 are additional rotated perspectives of the environmental views also depicted in FIGS. 3 and 4.
Figure 8:
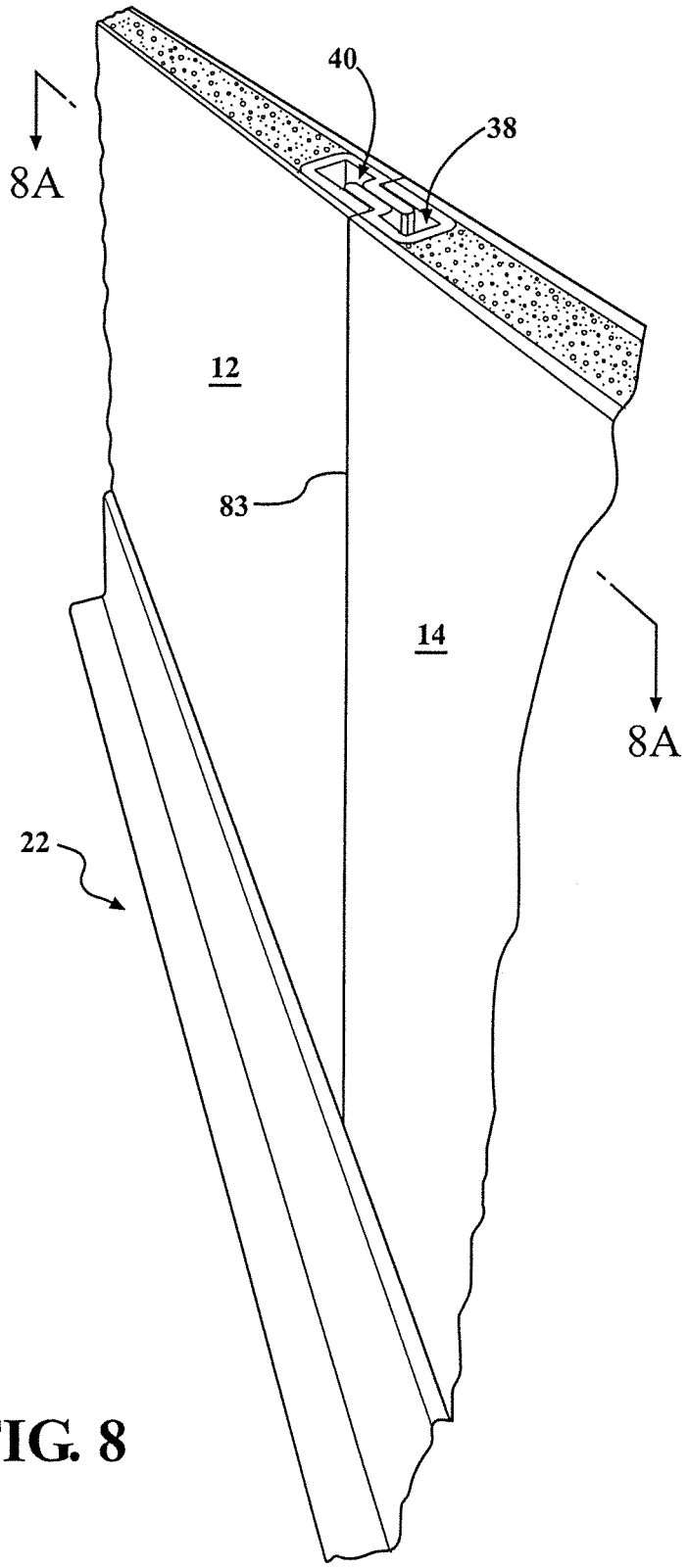

FIG. 3 is an environmental end view of the wall system, again including the base/track supporting molding 22 and a selected panel 12 with a first wall joiner edge profile or extrusion 38. FIG. 4 is a rotated perspective of the system of FIG. 3, again depicting the first 12 and second 14 panels with opposing wall joiner edge profiles or extrusions, such as again shown at 38 as well as at 40, these being arrayed in partially spaced fashion. FIGS. 7 and 8 are additional rotated perspectives of the environmental views also depicted in FIGS. 3 and 4.

Figure 5:
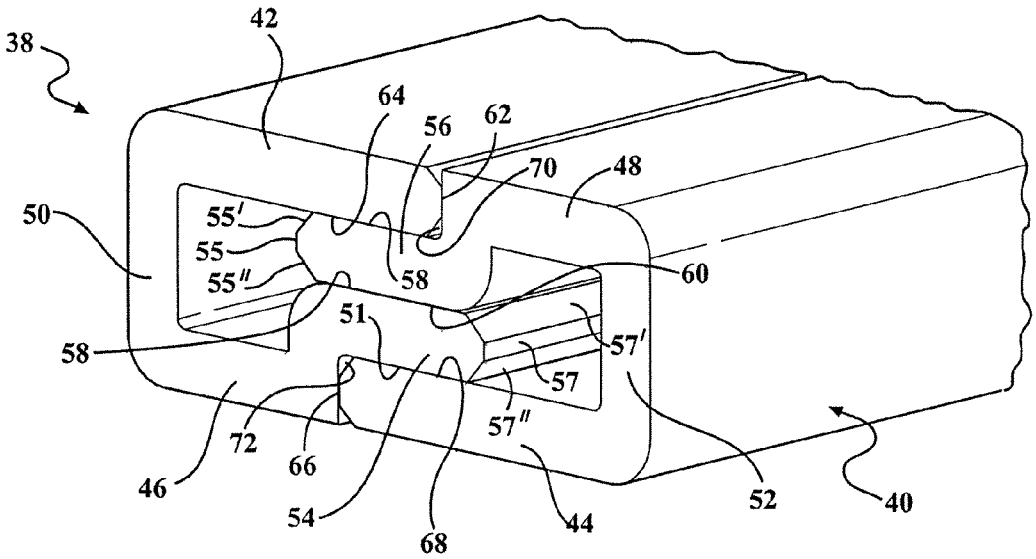
FIG. 5 is a perspective of first and second wall joiner edge extrusions detached from their respective panels and better depicting their interlocking configuration.

FIG. 5 is a cross sectional perspective in reduced length of the first 38 and second 40 wall joiner edge extrusions, detached from their respective panels 12 and 14 and better depicting their interlocking configuration. The wall joiner profiles 38 and 40 are each constructed of a rigid PVC or other suitable material and, without limitation, can also include a lightweight metal or other metal exhibiting the necessary properties of durability or resilience.

Figure 8A:
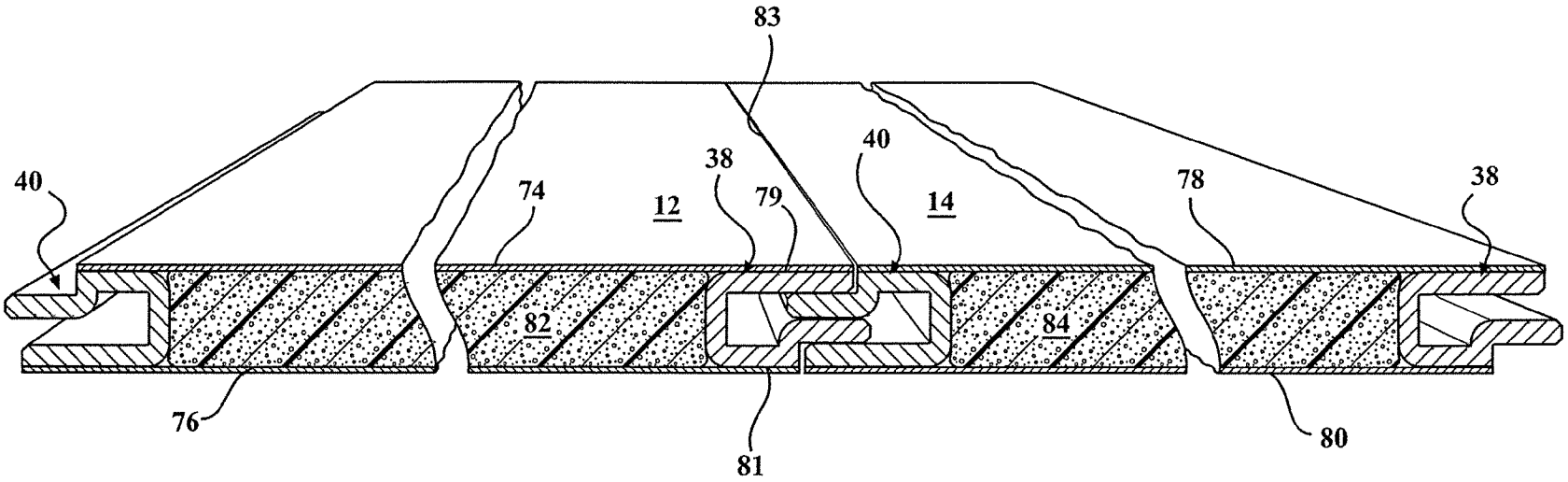
FIG. 8A is a cutaway perspective along line 8A-8A of FIG. 8 and depicting the manner in which the extrusions are configured within opposite extending joiner edges of the individual panel sections, these further exhibiting first outer and harder plastic skins in combination with foam/insulating interiors.

For purposes of the present inventions, the term "extrusion" in reference to the joiner edge profiles 38 and 40 is intended to denote one preferred embodiment for forming an elongated (such as again rigid PVC) material which is integrated or otherwise joined with the panel construction (see FIG. 8A). Without limitation, other modifications may include the pluralities of panels, such as representatively shown at 12 and 14, being reconfigured so that they may be injection molded or otherwise casted of a solid or other combination of materials not limited to those shown, and such as further which may contemplate the pairs of opposite edge extending profiles 38 and 40 being formed by other than an extrusion process, and such as being cast as one piece with the panel construction.

In the non-limiting variant depicted, each extrusion includes an outer three sided configuration with a longer outer side (at 42 for extrusion profile 38 and at 44 for extrusion profile 40), a shorter spaced apart outer side (at 46 for extrusion 38 and at 48 for extrusion 40), and an interconnecting inner or back surface (at 50 for extrusion 38 and at 52 for extrusion 40). The mating configuration associated with the extrusions 38 and 40 is established by inner stepped and outwardly projecting portions (at 54 for extrusion 38 and at 56 for extrusion 40).

As shown, the projecting portions 54 and 56 are inwardly stepped from the shorter outer sides 46 and 48 of the respective extrusions 38 and 40, such that the shorter sides and inwardly stepped projecting portions respectively establish outwardly facing engagement ledges for receiving the outermost extending portions of the longer sides 42 and 44. In this fashion, the extrusions are reversed or mirrored in the manner shown to provide overlapping channel engagement and so that the projecting portions 54 and 56 abut one another along opposing inner surfaces (58 and 60), concurrent with the outermost end and inside end proximate surfaces of the longer sides 42 and 44 (see additional pairs of locations at 62/64 and 66/68 respectively) overlapping the inner projecting portions 54 and 56 (along opposing inwardly stepped surfaces 51 and 53) and engaging the abutment ledges (such further referenced by inwardly stepped end walls 70/72) defining the inwardly stepped transition between the shorter outer walls 46 and 48 and the inner projecting portions 54 and 56.

The inner stepped and outwardly projecting portions 54 and 56 can further include angled end surface profiles, see central end surface 55 and adjoining upper 55' and lower 55" surfaces for portion 54. Likewise, the end profile of outwardly projecting portion 56 is characterized by central end surface 57 and adjoining upper 57' and lower 57" surfaces.

Figure 6:
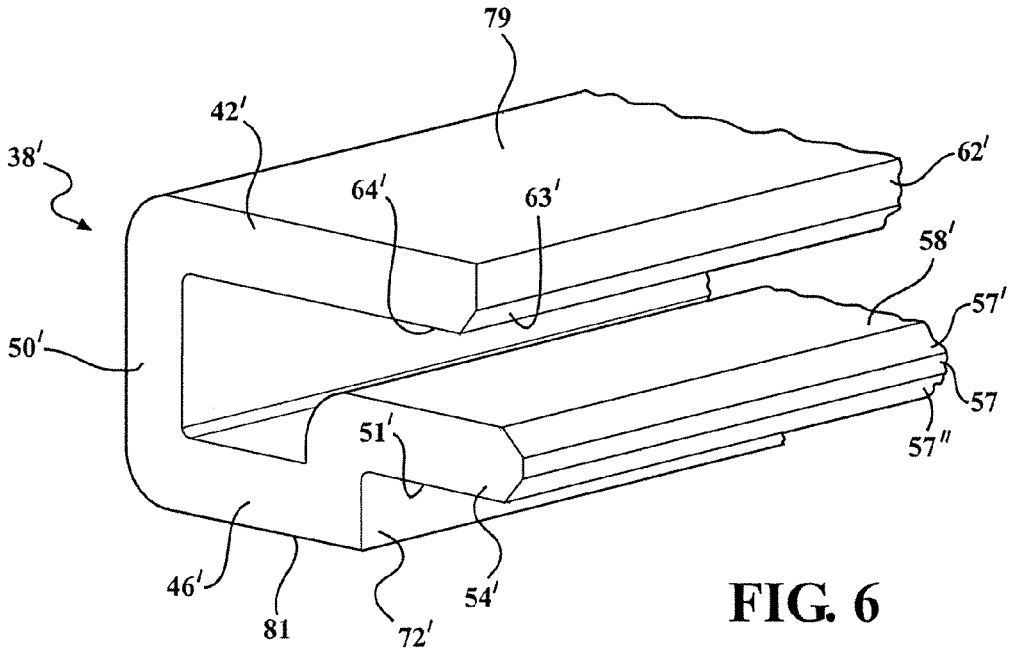
FIG. 6 is a further detail perspective of a single extrusion.

FIG. 6 is a further detail perspective of a single extrusion, at 38', similar to that depicted in FIG. 5 and more clearly illustrating the various surfaces (these being similarly referenced as compared to FIG. 5) associated with the mirroring and mating configuration. For purposes of ease of illustration, additional contoured edge locations, such as 63' associated with an underside angled surface adjoining face 62' and underside 64' is also depicted, with the angled end profile (surface 57, 57' and 57") for inwardly stepped and outwardly projecting portion 54' repeated from that depicted in FIG. 5. Without limitation, the interlocking configuration of the profile extrusions shown in FIGS. 5-6 can be varied without limitation and in order to achieve a desired frictional and secure inter-fitting relationship between the extrusions and associated panels to which they are mounted in edge extending fashion.

Proceeding to FIG. 8A, a cutaway perspective along line 8A-8A of FIG. 8 and depicting the manner in which the extrusions 38 and 40 are configured within opposite extending joiner edges of the individual panel sections 12 and 14. As further shown in FIG. 8A, the panels 12 and 14 according to the non-limiting construction shown, can each further exhibit first outer and harder plastic skins, such as which is shown at 74 and 76 for panel 12, and further at 78 and 80 for panel 14 in combination with the provision of expanded foam/insulating interiors 82 and 84.

Each of the panels 12 and 14 further depict a pair of extrusions 38 and 40 configured along their opposite joiner edges in the manner shown to assist in establishing a friction fit inter-assembly of any plurality of the panels in a continuously extending and supported fashion upon the base track 22. Specifically, the outer planar surfaces of the extrusion (further represented by surfaces 79 and 81 for extrusion 38' in FIG. 6, are depicted in FIG. 8A as bonded directly to the inside surfaces of the harder outer layers 74/76 of the selected panel section 12.

As further shown in FIG. 8A, the panel outer layers 74/76 (panel 12) and 78/80 (panel 14) are irregular to compensate for the cross sectional profile of the extrusions and further so that the assembled panels exhibit an abutting seam 83. Although not shown, additional panels may include varying planar dimensions (e.g. along its length and/or height) and the present system further contemplates any combination of panels having planar and/or angled and interconnected sides (not shown) along with corresponding multi-sided and outline establishing bottom tracks and top caps (see FIG. 9).

It is further envisioned and understood that the extrusions 38 and 40 (see as shown as opposing edge extending pairs for each panel 12, 14, et seq.) are capable of being produced in a molding or extruding operation along with the individual panels, such further not being limited to that shown. Additional envisioned applications include the extrusions being made from other materials and/or post applied to the edges of the panels.

Figure 9:
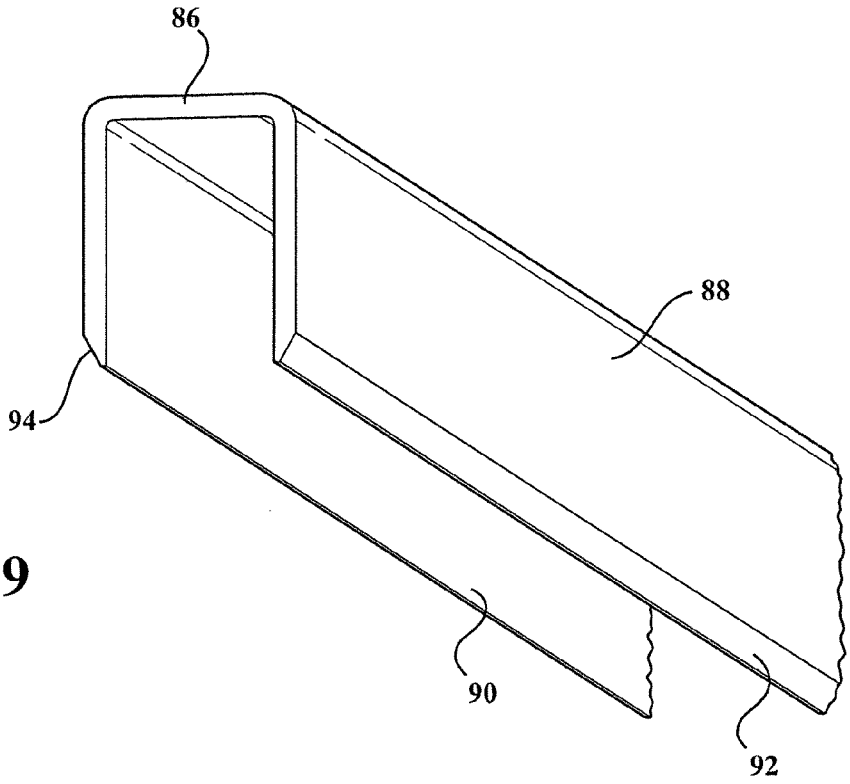
FIG. 9 is an illustration of a top cap which can be affixed upon a continuous upper edge established by the interconnected and track supported panels.

FIG. 9 is an illustration of a top cap, such having a generally "U" shaped cross sectional profile with a base 86 and interconnecting and parallel spaced outer walls 88 and 90, which can be affixed upon a continuous upper edge established by the interconnected and track supported panels 12 and 14. As shown, an exterior profile associated with the walls 88 and 90 may exhibit angled or tapered upper ends, at 92 and 94, such providing fit and finish aspects when secured over the interconnected top edges of the panels. As with the extrusions and base track, the caps can be constructed of a rigid PVC or other suitable material.

Figure 10:
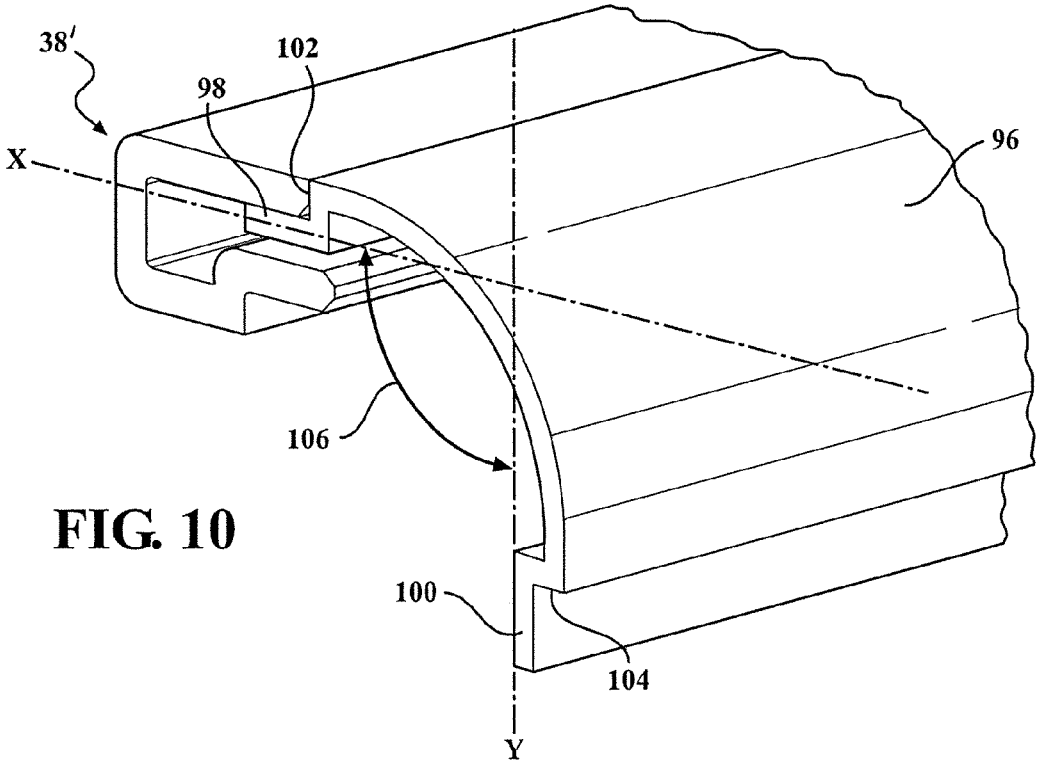
FIG. 10 is an illustration of a corner molding for establishing an angled corner profile between succeeding panels.

Referring to FIG. 10, an illustration is shown of an interfacing connection between a side extending extrusion (see such as previously as shown at 38') in combination with a corner molding, such further being constructed of a similar material to that associated with the side extending extrusions, bottom track and top cap. As further shown in FIG. 10, the corner molding typically exhibits a curved central body 96 terminating at opposite ends in an inwardly stepped engaging portion (see further inwardly stepped and opposite ninety degree end most straight portions 98 and 100 extending respectively from opposite end walls 102 and 104 which interface between the curved ends of the central body 96 and the engaging end portions 98/100).

As partially shown, the end portions 98 and 100 are angularly offset such as at 90° as reflected by angle 106 taken between x and y axes taken through center lines associated with the end portions 98 and 100. As further shown, the end portions 98/100 are dimensioned to fit between the opposing inner surface locations (see at 58' and 64' in FIG. 6) associated with the lateral receiving edge of the selected extrusion 38'.

While being depicted with a selected spacing between the thickness of the portions 98/100 and the inner space between the receiving and seating surfaces 58' and 64' of the selected extrusion 38', it is understood that the dimensioning between the opposing portions can be modified such that they establish a desired friction fitting arrangement such as which is also provided between the opposing extrusions 38 and 40 of FIG. 5. Additional variants contemplate the use of spacers or shims (not shown) for providing friction fitting between the corner molding and the successive panels (such as previously depicted at 12 and 14 and which according to the feature of FIG. 10 are repositioned from the linear mating arrangement of FIG. 1 to a ninety degree angled orientation.

Figure 11:
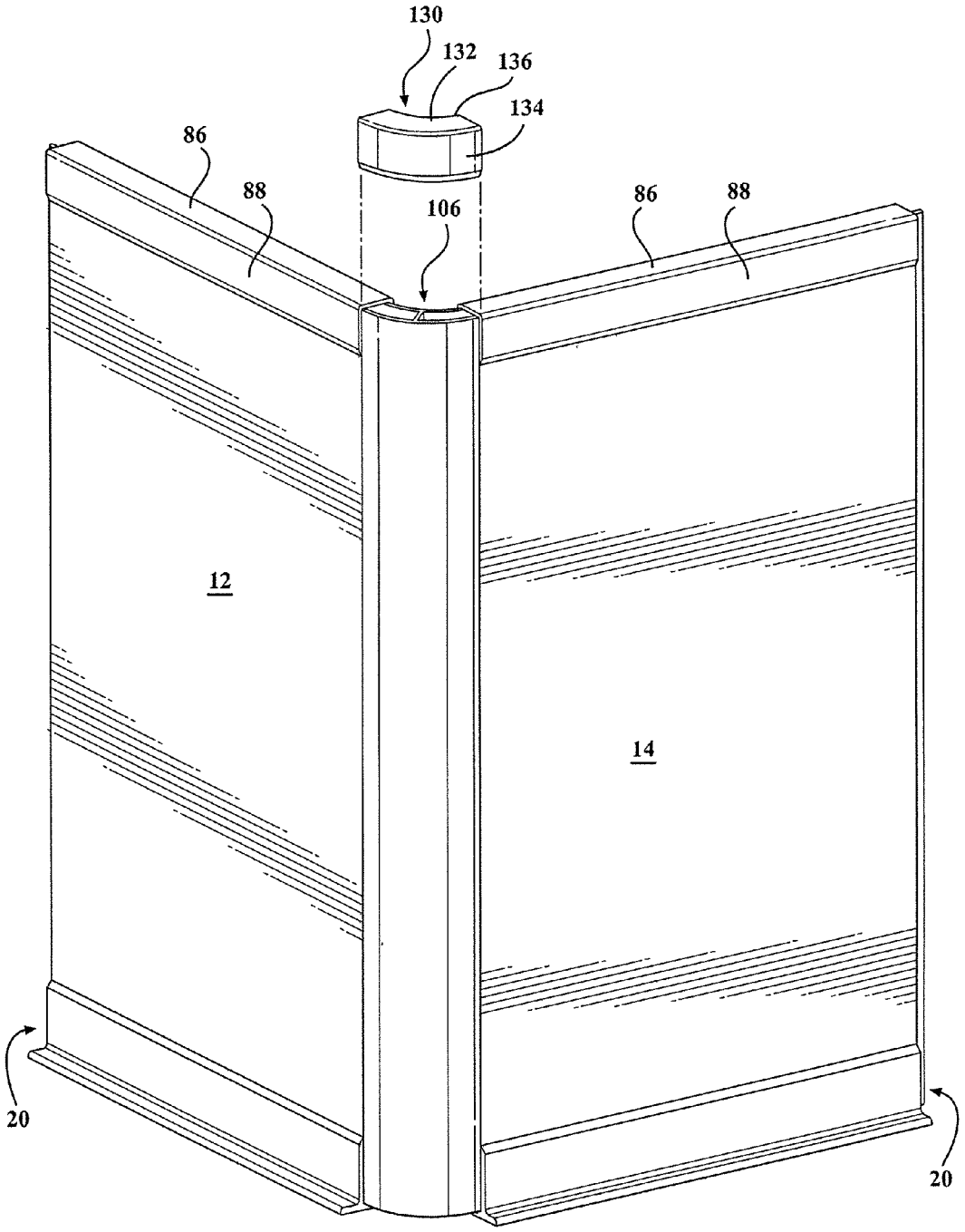
FIG. 11 is a partially exploded view of a further embodiment of the modular wall system integrating an arcuate corner with a likewise arcuate corner cap.

Proceeding to FIG. 11 (as well as to succeeding views FIGS. 12-13) a partially exploded view is depicted of a variant, generally at 106, of a curved corner interconnecting portion, defined as any of an extrusion or molding, according to a further embodiment of the modular wall system for integrating an arcuate corner between a pair of angled panels 12 and 14. As shown, the panels 12 and 14 are arranged in a non-limiting 90 degree angular orientation and are further supported upon bottom track supporting sections 20 as well as having top supported caps (see upper 86 and outer 88) interconnected walls.

Figure 12:
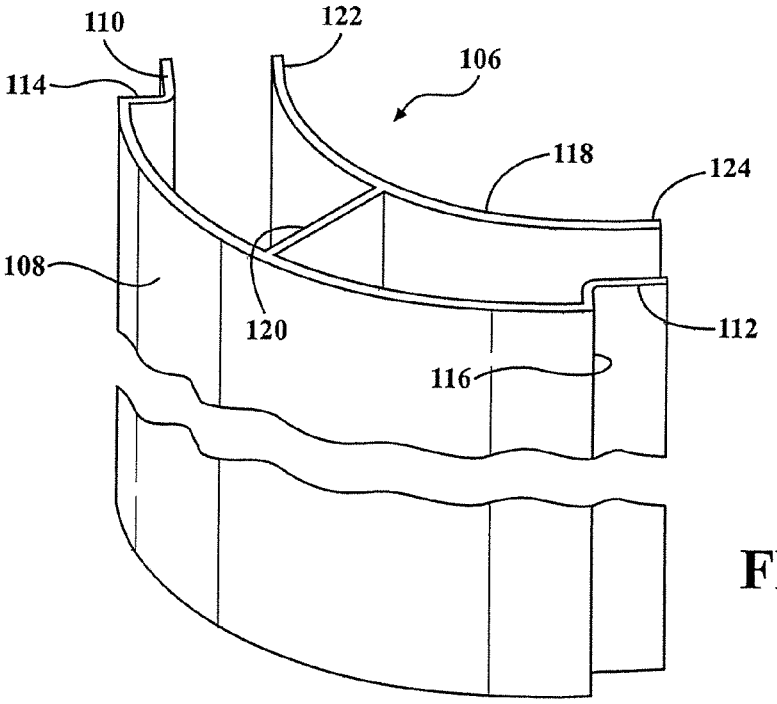
FIG. 12 is an enlarged and reduced length perspective of the corner interconnecting portion in use with first and second generally perpendicular arranged wall sections.
Figure 13:
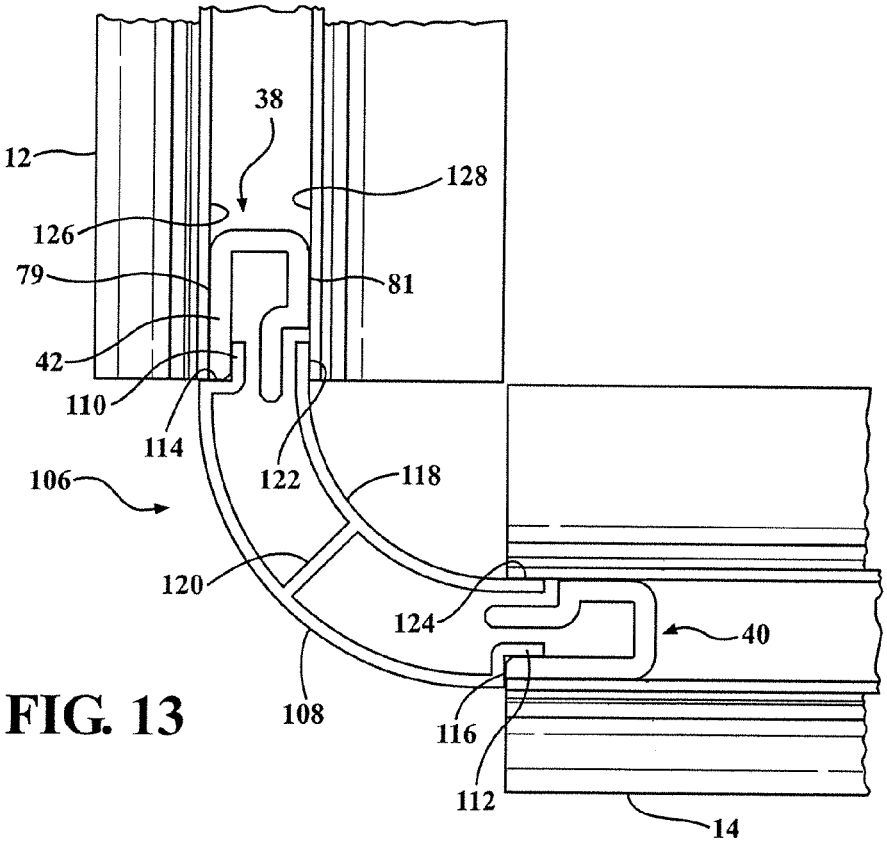
FIG. 13 is a top plan view of the wall corner engaged with the wall joiner edge extrusions.

As further shown in each of the enlarged and reduced length perspective of FIG. 12 of the corner interconnecting portion in use with first and second generally perpendicular arranged wall sections 12 and 14, as well as the top plan view of FIG. 13 of the wall corner engaged with the wall joiner edge extrusions, the corner molding 106 is functionally similar to that depicted previously in FIG. 9 and includes a curved outer layer 108 (compare to 96 in FIG. 10) terminating at opposite ends in an inwardly stepped engaging portion (see further inwardly stepped and opposite ninety degree end most straight portions 110 and 112 which compare to 98 and 100 of FIG. 9 and which extend respectively from opposite end walls 114 and 116, as further compared to at 102 and 104) and which interface between the curved ends of the central outer layer 108 and the engaging end portions 110 and 112).

The three dimensional and cross sectional design of the arcuate corner molding 106 is further exhibited by an inner curved layer 118 which is spatially arrayed relative to and interconnected with the outer layer 108 via an interconnecting web 120. The inner curved layer 118 is further exhibited by end proximate support surfaces, see at 122 and 124 as best shown in FIGS. 12-13.

As further best shown in the top plan view of FIG. 13, the mounting arrangement of the edge extending extrusions 38 and 40 relative to the panel extending edges is modified from that depicted in FIG. 8A (as well as understood to apply to the initially disclosed curved mounting relationship of FIG. 10). Specifically, and as opposed to the mounting arrangement established between the outer planar edges of the extrusions 38 and 40 and the inside hardened skin surfaces of the panels (see at 74/76 and 78/80 for panels 12 and 14), the extrusions 38 and 40 in FIG. 13 are reconfigured to seat deeper within the side extending edges of the panels.

As shown in FIG. 13, the surface 79 abuts flush with an edge of a first inside surface 126 of the panel whereas the opposite surface 81 is retracted inwardly from an edge of an opposing second inside surface 128 of selected panel 12. In this manner, the stepped end portions 110 and 112 of the outer curved layer 108 frictionally fit or bias against the inside surface of the longer side 42 or 44 of the given extrusion, with the inwardly spaced and arcuate extending end surfaces 122 and 124 of the inner layer 118 likewise abutting against the second inside edge proximate surfaces (see again at 128 in FIG. 13 for selected panel 12).

Upon installation, the curved fitting 106 provides three dimensional support along outer and inner curved layers, as compared to that associated with the example 96 of FIG. 10, in order to array the panels 12 and 14 in a ninety degree or other possible orientation. Without limitation, the cutaway configuration of the panels 12 and 14 can include any of those depicted in FIGS. 8A or 13 and which may include an extruded or injection molded notch or recess along its opposite extending sides into which the extrusions are concurrently formed or subsequently installed.

As further shown in FIG. 13, the side edge projecting profiles (e.g. extrusions 38/40) in this variant are not alternating as compared to the arrangement of FIGS. 5 and 8A, rather they are mirrored as shown in extending fashion along the opposing edges of the panels 12 and 14 for engagement by the three dimensional variant 106 of the arcuate corner interconnecting portion as previously described. Without limitation, the opposing arrangement of extrusions 38/40 can be reconfigured as shown in FIG. 8A concurrent with modifying the corner portion 106 such that the opposite curved ends are reversed in configuration.

Finally, and as also shown in FIG. 11, a corner top cap 130 can be provided which seats over the three dimensional corner molding 106. The corner top cap 130 includes a top surface 132 with interconnecting front 134 and rear 136 surfaces which fit over the exposed top of the corner molding 106 in seam abutting fashion with the linear top caps 86 secured atop the panels 12, 14, et seq.

Having described my invention, other and additional preferred embodiments will become apparent to those skilled in the art to which it pertains, and without deviating from the scope of the appended claims. Such can include the edge joiner extrusions 38 and 40 being reconfigured in any manner desired beyond that shown and in order to provide an adequate friction inducing and mating engagement between the joiner edges of the panels.

I claim:

1. A modular wall system for use within an interior space, comprising:

a plurality of panels, each having first and second opposite surfaces bounded by a top, a bottom, and first and second interconnecting joiner side edges;

said joiner side edges of each panel further including an elongated extrusion mounted between said panel surfaces, said extrusion having, in cross section, a longer outer side and a shorter outer side supporting an inwardly stepped portion separated by an interconnecting base surface, said longer side and inward step defining a gap therebetween in communication with an interior of said extrusion, said gap being approximate in thickness to said inwardly stepped portion;

the first of said panel surfaces extending to a forwardmost edge of said longer side, the second panel surface extending to an adjoining edge between said inward step and said shorter side, such that vertical extending side edges of said panels supporting each extrusion are linearly offset;

a floor supported track for seating said bottoms of interconnecting panels; and upon arranging said panels in plural interconnecting fashion, each pair of extrusions exhibiting an opposing and mirroring configuration, causing said inward step of each extrusion to inter-engage within said gap on both sides of said opposing extrusion and in friction fitting contact between inner opposing surfaces of said longer side and said inward step.

2. The modular wall system as described in claim 1, further comprising a top cap for securing said tops of said interconnecting panels.

3. The modular wall system as described in claim 2, said top cap further comprising a generally "U" shaped cross sectional profile with a base and interconnecting and parallel spaced outer walls.

4. The modular wall system as described in claim 2, each of said joiner side edges, top cap and floor supported track further comprising a rigid PVC material.

5. The modular wall system as described in claim 1, further comprising said inwardly stepped portions of said inter-engaging extrusions having outwardly facing engagement ledges for receiving outermost extending portions of said longer outer sides.

6. The modular wall system as described in claim 1, further comprising foam insulating interiors between said panel surfaces.

7. The modular wall system as described in claim 1, further comprising a corner molding for engaging opposing joiner side edges associated with first and second panels and in order to array said panels in an angular fashion relative to one another.

8. The modular wall system as described in claim 7, said corner molding further comprising a curved central body terminating at opposite ends in inwardly stepped engaging portions which interface between said curved ends of said central body and said engaging portions.

9. The modular wall system as described in claim 8, said curved central body further comprising an outer layer, said corner molding further having an inner curved layer.

* * * * *